United States Patent [19]

Simpkins

[11] 4,360,978

[45] Nov. 30, 1982

[54] SHOE SPRING DEVICE

[76] Inventor: N. J. Simpkins, 1815 Bragg St., Chamblee, Ga. 30341

[21] Appl. No.: 226,523

[22] Filed: Jan. 19, 1981

[51] Int. Cl.[3] ..... A43B 5/00; A43B 3/10

[52] U.S. Cl. ..... 36/114; 36/7.8

[58] Field of Search ..... 36/114, 7.8, 27, 28

[56] References Cited

U.S. PATENT DOCUMENTS

| | | | |
|---|---|---|---|
| 1,587,749 | 6/1926 | Bierly | 36/7.8 |
| 2,172,000 | 9/1939 | Wenker | 36/7.8 |
| 3,013,764 | 12/1961 | Kuhn | 36/7.8 |
| 3,036,389 | 5/1962 | Wosch | 36/7.8 |

*Primary Examiner*—Patrick D. Lawson

*Attorney, Agent, or Firm*—Victor J. Evans & Co.

[57] ABSTRACT

A spring device for a shoe such as a skate shoe having a sole plate provided with threaded bolts for mounting wheels which includes a unitary strip of spring metal having upper and lower portions arranged in vertically spaced, parallel relationship and having a length corresponding generally to the distance between the toe and heel of the shoe, the upper and lower portions being interconnected by a rearwardly and downwardly inclined intermediate portion with apertures in the upper portion for accommodating the bolts so that with the use of nuts the upper portion may be detachably mounted on the sole plate thereby providing a spring action for movement on the ground by the wearer of the shoes.

5 Claims, 2 Drawing Figures

FIG 1
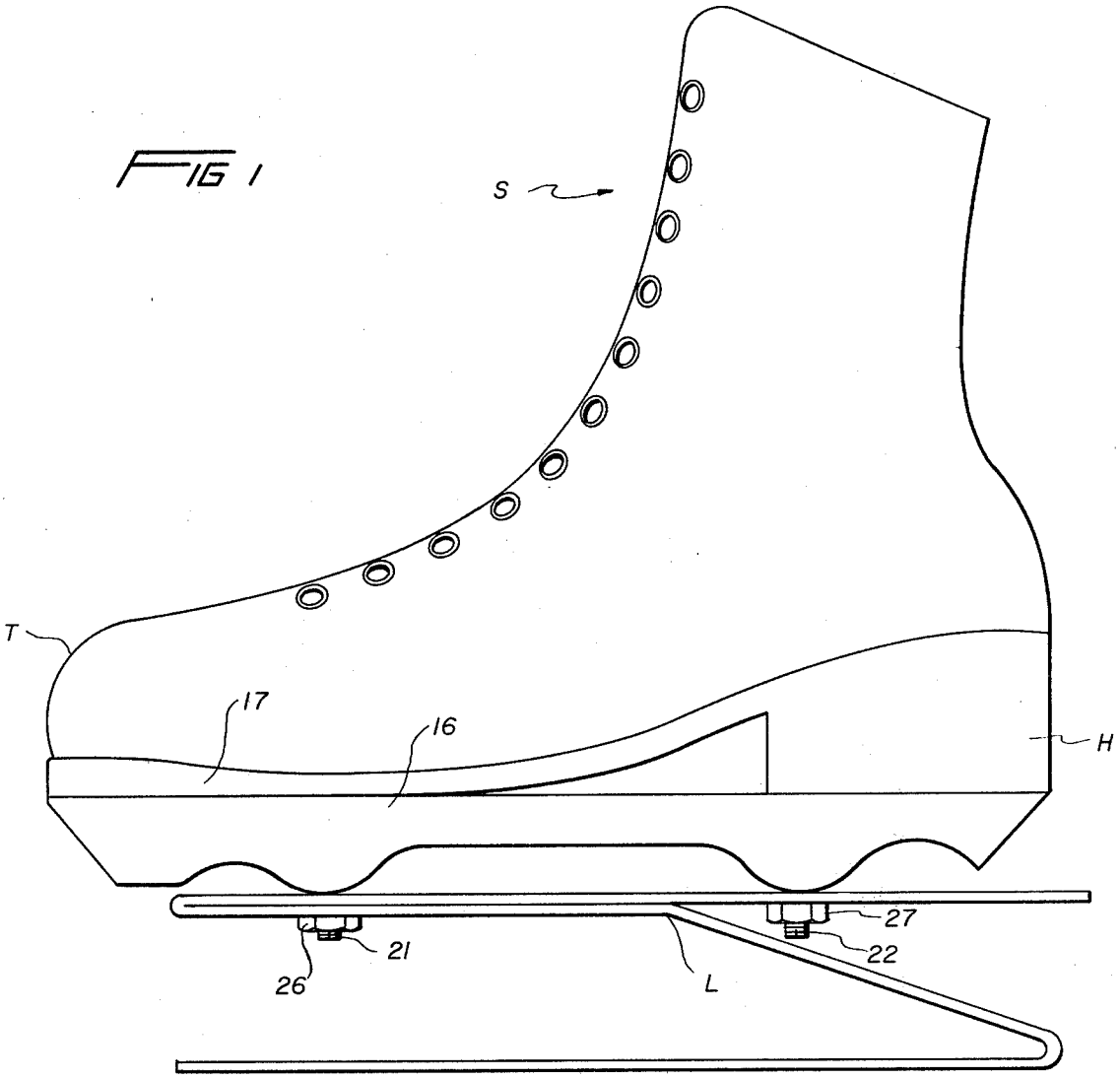
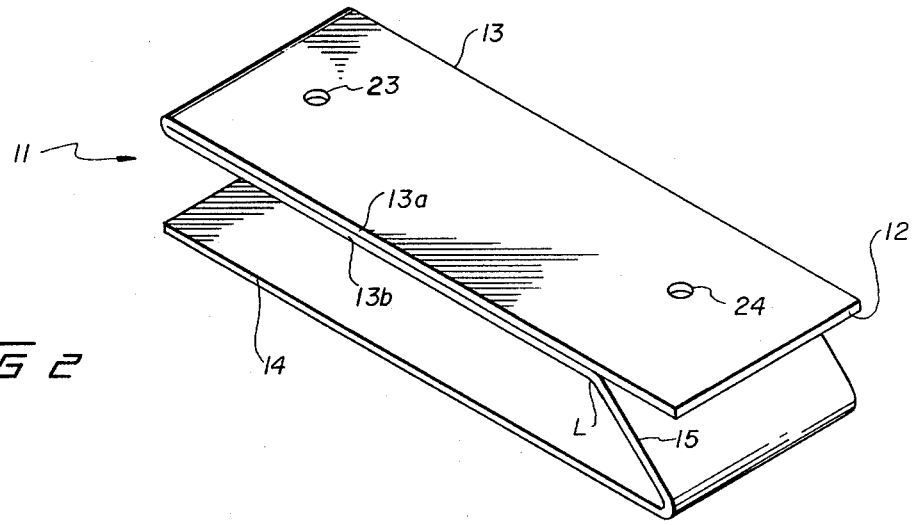
FIG 2

SHOE SPRING DEVICE

BACKGROUND OF THE INVENTION

It has been proposed in the past to provide various elastic or resilient means on the sole of a shoe to provide a degree "springiness" under the foot of the wearer of the shoes. However, such prior art spring devices are characterized by many limitations whether they are separately attached to the soles of the shoes or whether they are built into the shoe sole. Obviously, to build such spring devices into the shoe adds considerably to the manufacturing cost of the shoe and furthermore limits the use of the shoe for a single purpose. Where spring devices are separately attached to a shoe, some, modification of the shoe sole is still necessary and, in addition, are limited in durability, performance and effectiveness.

The following prior art patents are representative of spring devices for use on shoes all of which are clearly distinguishable from that of applicant's invention: U.S. Pat. Nos. 1,571,073, Tapling; 4,030,213, Daswick; and 3,668,792, York.

The York patent refers to an athletic safety shoe provided with a safety sole having a grooved track configured to slidably receive a rib with a pressure piece engaged with the rib biases by a spring into frictional engagement with the rib. The Daswick patent is directed to a sporting shoe having a relatively thick sole in which a plurality of springs are embedded to enhance the compressive and expansive ability of the resilient sole members 15, 16. The Tapling patent relates to an exercising device which include a sole plate 1 arranged to be attached to a shoe and having a runner formed of a steel strip 2 configured in a arcuate fashion throughout and attached to the sole plate 1 adjustably so that the wearer of the shoes may perform a jumping or leaping action.

OBJECTS AND SUMMARY OF THE INVENTION

Accordingly, a primary object of this invention is to provide a new and novel spring device to be worn on the shoe.

Another object of this invention is to provide a new and novel spring device which is attached to the bottom of a shoe to thereby provide a spring action for the wearer during walking, running or the like.

A further object of this invention is to provide a new and novel spring device for a skate shoe which may be simply and easily attached to the skate shoe without modification and which therefore does not require a special shoe.

Still another object of this invention is to provide a new and novel spring device for a skate shoe which utilizes the weight of the wearer to propel the wearer forward with less energy and which absorbs shock as well as avoiding damage to the heel during use.

A still further object of this invention is to provide a new and novel spring device which is simple and inexpensive in construction, which may be attached to a commercially available skate shoe and which is capable of prolonged use without wear.

The objects of this invention and other related objects are accomplished by the provision of a unitary strip of spring metal which includes substantially straight upper and lower portions of approximately the same length which are arranged in vertically spaced, substantially parallel relationship and a rearwardly and downwardly inclined intermediate portion interconnecting the upper and lower portions. Means are provided for detachably mounting the upper portion of the unitary strip to the bottom of a shoe and more particularly to the base plate of a skate shoe in underlying relationship therewith with the upper and lower portions of the strip extending between the heel and the toe of the shoe.

Other objects and advantages will become apparent in the following specification when considered in light of the attached drawings.

BRIEF DESCRIPTION OF THE DRAWINGS

FIG. 1 is a side elevation view of a spring device constructed in accordance with the invention in the mounted position on a skate shoe; and FIG. 2 is a perspective view of the spring device of FIG. 1.

DESCRIPTION OF THE PREFERRED EMBODIMENT

Referring now to the drawings and to FIG. 2 in particular, there is shown a spring device constructed in accordance with the invention and designated generally by the reference numeral 11. As will be explained hereinafer the spring device 11 is adapted to be mounted on the bottom of a shoe such as a skate shoe designated generally by the letter S in FIG. 1 so as to provide a spring action under the foot of the wearer of the shoes.

The spring device 11 comprises a unitary strip 12 of spring metal or the like which is configured so as to provide a substantially straight upper portion 13 and a substantially straight lower portion 14 and an intermediate portion 15 extending rearwardly and downwardly between the upper portion 13 and lower portion 14 as shown in FIG. 2. Shown in FIG. 1, the upper portion 13 and lower 14 are of substantially the same length so as to extend between the toe T and heel H of the shoe S in the installed position.

The upper portion 13 is formed by folding the strip 12 back upon itself in a double layer construction to provide a top section **13*a* and a bottom section 13*b* disposed in overlapping relationship with the intermediate portion 15 diverging downwardly from the bottom section 13*b* at a location L intermediate the ends of the top section 13*a*. Thus, the top section 13*a* extends rewardly in a substantially horizontal plane throughout the top section 13*a*** rearwardly from the location L.

Means are provided for detachably mounting the upper section 13 of the strip 12 to the bottom of the shoe S in underlying relationship therewith. More specifically, the skate shoe S is of a well known, commercially available type having a base plate 16 of metal or the like suitably secured to the sole 17 and heel H of the shoe. As is well known, bolt means are provided on the base plate 16 by means of which skate wheels are attached to the shoe S.

As is well known, the skate shoe base plate 16 is provided with a pair of threaded bolts 21, 22 fixedly mounted thereon and which permit the skate wheels to be attached to the base plate 16 and therefore the shoe S in the well known manner. These threaded bolts 21, 22 are utilized as the means by which the spring device 11 is attached to the shoe S.

More specifically, the upper portion 13 of the spring device 11 is provided with a pair of apertures 23, 24 arranged in longitudinally spaced relationship corresponding to the spacing of the bolts 21, 22. One of the apertures, namely aperture 23 extends through both the top and bottom sections 13*a*, 13*b* of the upper portion 13 adjacent the front end of the spring device 11 with the other of the apertures 24 extending through the top section 13*a* only adjacent the rear of the spring device 11. Thus, to mount the spring device 11 on the base plate 16 the bolts 21, 22 are inserted within the apertures 23, 24 respectively and the upper portion 13 is secured in the mounted position on the base plate 16 by means of nuts 26, 27 engagable with the threaded bolts 21, 22 respectively.

With the spring device 11 mounted on a each of a pair of shoes S a spring action is obtained during use by the wearer of the shoes and the wearer's weight causes the wearer to be propelled forward by the reaction to change of weight on the part of the spring device 11 thereby carrying the wearer along with less energy. Furthermore, as the heel H presses down on the rear of the spring device 11 shock is absorbed and damage to the heel of the wearer is avoided.

Having thus described the preferred embodiment of the invention it should be understood that numerous structural modification and adaptations may be resorted to without departing from the spirit of the invention.

What is claimed is:

1. A spring device for shoe such as a roller skate shoe comprising, in combination, a unitary strip of spring metal including substantially straight upper and lower portions arranged in horizontal, spaced-apart parallel relationship and a rearwardly and downwardly inclined intermediate portion between said upper and lower portions, said upper and lower portions having approximately the same length and means for detachably mounting said upper portion to the bottom of said shoe in underlying relationship therewith with said upper and lower portions extending between the toe and heel of said shoe wherein said strip is folded back upon itself to provide a top and bottom strip section arranged in overlapping relationship to define said upper portion.

2. A spring device in accordance with claim 1 wherein said detachable mounting means includes a pair of longitudinally spaced apertures in said upper portion and bolt means extending through said apertures for mounting engagement with the bottom of said skate shoe.

3. A spring device in accordance with claim 2 including a base plate secured to the sole of said skate shoe and wherein said bolt means include a pair of threaded bolts on said base plate arranged in spaced relationship corresponding with the spacing of said apertures in said upper portions for insertion within said apertures and a nut threadedly engagable with said bolts to mount said upper portion on said base plate.

4. A spring device in accordance with claim 3 wherein said intermediate portion diverges from said bottom section rearwardly and downwardly at a position intermediate the ends of said top section with said top section extending rearwardly from said intermediate location in substantially parallel relationship with said lower portion.

5. A spring device in accordance with claim 4 wherein one of said apertures extends through both said top and bottom sections of said upper portion adjacent the front end of said upper portion and wherein the other of said apertures extends through said top section adjacent the rear end of said upper portion.

* * * * *